United States Patent [19]

Corbin

[11] Patent Number: 4,471,921

[45] Date of Patent: Sep. 18, 1984

[54] REEL WIRE DISPENSER

[76] Inventor: N. J. Corbin, 2751 Old Grade Rd., Dalton, Ga. 30720

[21] Appl. No.: 423,513

[22] Filed: Sep. 27, 1982

[51] Int. Cl.[3] ..... B65H 49/00

[52] U.S. Cl. ..... 242/129; 242/105

[58] Field of Search ..... 242/54 R, 105, 129, 242/129.5, 129.7, 146

[56] References Cited

U.S. PATENT DOCUMENTS

| | | | |
|---|---|---|---|
| 1,147,680 | 7/1915 | Crawford . | |
| 2,286,460 | 6/1942 | Brown . | |
| 2,847,172 | 8/1958 | Salkield | 242/129 |
| 3,118,634 | 1/1964 | Shumake | 242/129 |
| 3,186,659 | 6/1965 | Arnold | 242/129 |
| 3,298,631 | 1/1967 | Richardson, Jr. . | |
| 3,464,647 | 4/1968 | Jacobi . | |
| 3,593,943 | 7/1971 | Collman | 242/129 |
| 3,731,888 | 5/1973 | Cassel et al. . | |
| 3,837,597 | 9/1974 | Bourhenne | 242/129 |

*Primary Examiner*—Leonard D. Christian
*Attorney, Agent, or Firm*—Jones & Askew

[57] ABSTRACT

A portable wire dispenser for use as a convenient method of storing and dispensing wire has a rotatable reel attached to a base. The base surrounds the reel with a case to prevent the wire from uncoiling after it is pulled off the reel. The dispenser provides a convenient means for storing and dispensing stiff wire with no kinking or unraveling of the wire.

6 Claims, 6 Drawing Figures

REEL WIRE DISPENSER

TECHNICAL FIELD

The present invention relates to wire dispensers and more particularly relates to an apparatus that provides a convenient means of storing and dispensing stiff wire while preventing unwanted kinking and unwinding.

BACKGROUND ART

Wire and cable used by electricians to wire buildings is supplied in large continuous rolls, usually packed in a cardboard box. Typically, a hole is cut in the center of the box and the wire is pulled directly from the container as needed. However, when the electrician pulls the wire from the cardboard container, the wire being dispensed tends to loop upon itself causing kinks and bends due to the looping of the wire as it uncoils. This causes the electrician to constantly interrupt his work to straighten the kinks and bends in the wire. These kinks also cause delays by making it more difficult to pull the wire through the small holes in wall studs or flooring.

Placing the wire on a revolving reel does not alleviate the problem. Representative of such prior art wire dispensing systems are the wire dispensing systems disclosed in U.S. Pat. No. 2,847,172 and U.S. Pat. No. 3,837,597. In both of these systems, the coil of wire is placed on a revolving reel and the wire is pulled off the coil as needed. However, even with a brake on the reel, the wire tends to continue unwinding and loop over the central cylinder of the reel or out over the bottom part of the reel. When the wire is again pulled, a loop or kink will form in the wire.

SUMMARY OF THE INVENTION

The foregoing problems are solved by the present invention by having a base that partially surrounds the rotating reel and prevents the wire from looping up and over the central cylinder of the reel. The present invention allows wire to be smoothly and efficiently supplied as required by the user without kinks or bends. This wire dispenser freely dispenses the coiled wire from the periphery of the coil under the urging of the wire user.

Generally described, the present invention comprises a rotatable reel on a base, a pivot post rigidly mounted on the base and extending upwardly. The base forms a cage around the reel comprising a plurality of L-shaped base arms connected to the post radiating horizontally, and then vertically to provide retaining extensions extending to a height greater than the height of the reel. The retaining extensions then extend upwardly over the reel and are interconnected by a base retaining ring. The reel comprises a plurality of L-shaped radial reel arms connected to the lower portion of a mounting tube which fits over the pivot post of the base. The ends of the reel arms are interconnected with a reel retaining ring. The reel is mounted on the base pivot post so that it may freely rotate. A circular plate can be attached axially to the bottom of the base if desired.

Coiled wire or cable is first removed from its cardboard shipping container and is placed upon the reel. The coiled wire dispenser reel accepts a complete coil of wire. One embodiment of the present invention has located on the base retaining ring a wire guide through which the wire is fed. The wire user then pulls the wire through the wire guide and the wire is reeled off the coil as needed. When the wire user stops pulling the wire, inertial forces cause the reel to continue to rotate, unreeling a small amount of additional wire which hits the vertical portion of the radiating arms of the reel or base, efficiently stopping rotation of the reel and preventing tangling of the wire. The inwardly extending base arms over the reel prevents the wire from uncoiling vertically off of the dispenser as linear tension on the wire is stopped and momentum continues the rotation of the reel.

Accordingly, an object of the present invention is to provide a portable dispenser for coiled material.

A further object of the present invention is to provide a dispensing device for coiled material wherein there is an automatically operative braking mechanism to prevent uncoiling of the wire when dispensing a length of the wire.

A further object of the present invention is to provide a dispensing device for coiled material wherein the base of the dispenser partially surrounds the dispensing reel and prevents the wire from uncoiling in a vertical direction.

A further object of the present invention is to provide a dispensing device which may be easily transported and in which wire may be stored until needed.

Other objects, features and advantages of the present invention will become apparent upon reading the following specification when taken in conjunction with the accompanying drawing.

DETAILED DESCRIPTION

Figure 1:
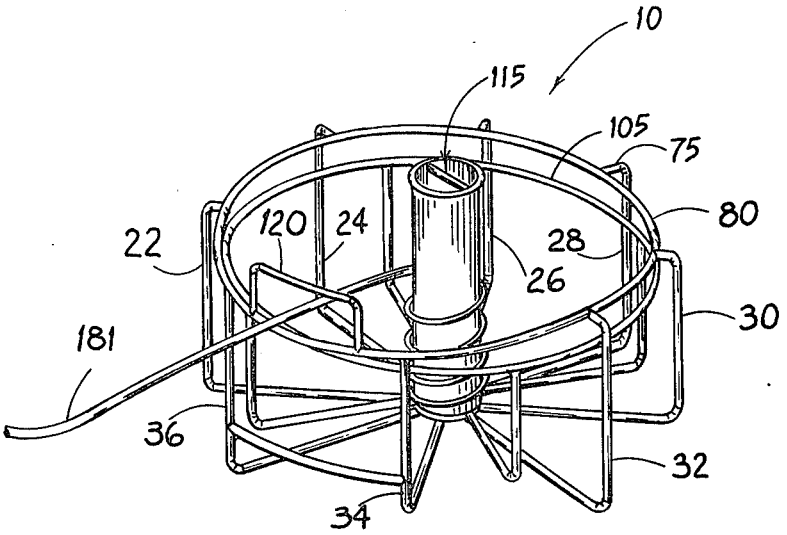
FIG. 1 is a perspective view of the present invention.
Figure 2:
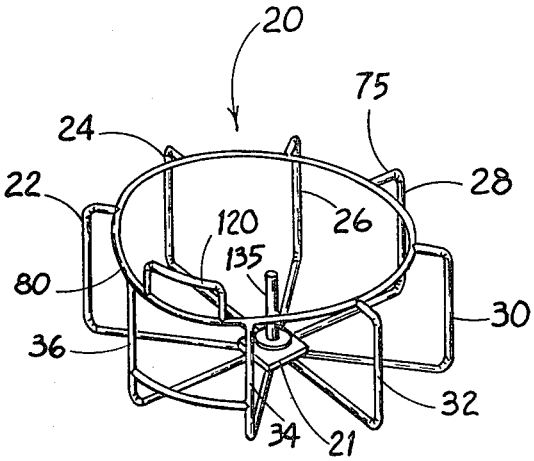
FIG. 2 is a perspective view of the base of the wire dispenser of FIG. 1.

Referring now to the drawing in which like numbers indicate like elements, throughout the several views, FIG. 1 shows the preferred embodiment of a wire dispenser 10 according to the present invention. The dispenser 10 includes a base 20 shown best in FIG. 2, with a rotatable reel 15 shown best in FIG. 3, mounted on a base post 135.

Figure 4:
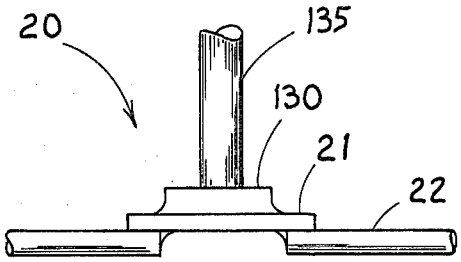
FIG. 4 is a view of the base plate and post of the base.

The base 20 comprises a plurality of equally spaced L-shaped base retention arms 22, 24, 26, 28, 30, 32, 36 radially extending horizontally from a base plate 21 shown in FIG. 4; the base retention arms 22–36 extending a distance greater than that of the radius of the reel 15. The base retention arms 22–36 then extend vertically to a height greater than the reel 15. The base retention arms 22–32 then extend inwardly to define a horizontal segment 75 preferably having a length approximately one sixth the diameter of the base 20. In the preferred embodiment of the present invention shown in FIGS. 1 and 2, the base retention arms 34 and 36 do not have inward extensions. The ends of inwardly extended arms 75 are interconnected with a base retaining ring 80. The retaining ring 80 extends to and connects with the ends of the arms 34 and 36 forming an off-center retaining ring 80. In the preferred embodiment, a rectangular wire guide 120 is connected to the retaining ring 80 equidistant between the points where arms 34 and 36 connect to ring 80.

It will be understood that the extent to which the segments 75 overlie the reel 15 can vary, so long as the overlying segments prevent vertical escape of wire as explained below and so long as a coil or wire fits within the ring 80 onto reel 15.

In FIG. 4 is shown in more detail the post 135 attached to the center of base plate 21 and a nylon bushing 130 attached to the bottom of the post 135.

Figure 3:
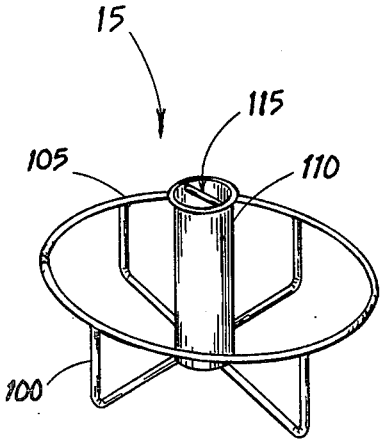
FIG. 3 is a perspective view of the reel in the wire dispenser in FIG. 1.

In FIG. 3 is shown the inner reel 15 which comprises a plurality of equally spaced L-shaped reel retention arms 100 radially extending horizontally from the bottom of a reel cylinder 110, the reel retention arms extending a distance less than the radius of the base 20. The reel retention arms 100 then extend vertically to a height less than the base arms 22–36. A reel retaining ring 105 interconnects the ends of the vertical portion of the reel retention arms 100.

Figure 5:
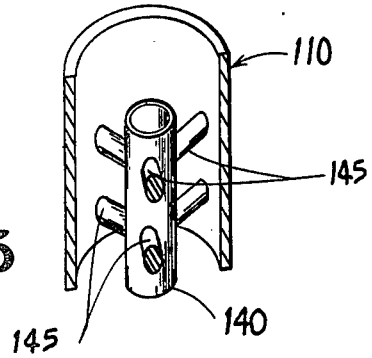
FIG. 5 is a cut away view of the reel cylinder.

FIG. 5 shows a cutaway view of the reel cylinder 110 in which a tube 140 that slidably mounts the post 135 is axially attached to the inside of the cylinder 110 by tube support arms 145. The tube 140 rests on the nylon bushing 130 which reduces friction and allows the reel 15 to freely rotate.

In using the present invention a coil of wire is placed on the reel 15. The coil of wire is centrally located and supported and centered upon the reel 15 by means of the cylinder 110 and the reel retention arms 100. The reel retention arms 100 prevent the wire from uncoiling. The peripheral end of the wire is then threaded through wire guide 120, over the ring 80.

In actual practice the present invention is placed on a horizontal surface. As the wire user pulls linearly on the end of the wire, the reel 15 turns as long as there is tension on the wire. When the tension is terminated, the reel 15 continues to turn unwinding a short length of wire until coils of the wire moving horizontally hit against the reel retaining arms 100 or the base retaining arms 45 stopping the rotation of the reel 15. The reel retaining arms 100, the base retention arms 22–36, the inwardly extending segments 75 and the base retaining ring 80 above and over the dispensing reel all keep the wire from uncoiling horizontally or vertically and prevent crimps and bends from occurring. This allows the wire user to work without having to straighten or untangle the wire.

Figure 6:
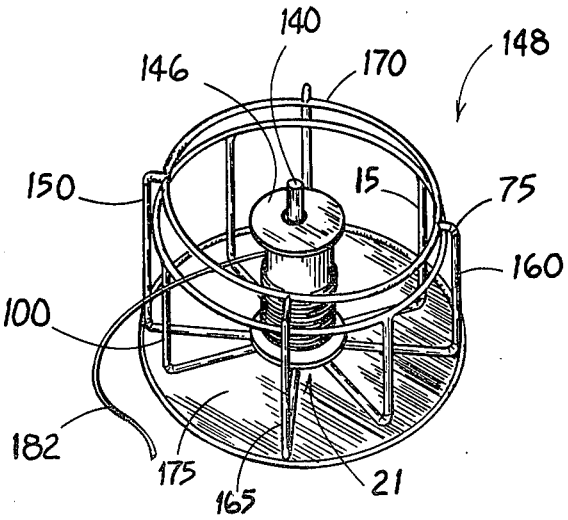
FIG. 6 is a perspective view of a second embodiment of the present invention.

In FIG. 6 is shown a second embodiment of the present invention 148. This embodiment is designed to dispense thin wire that is coiled on a spool 146 with an axial hole. The reel and base are similar to the first embodiment shown in FIG. 1. The base 20 comprises a plurality of equally spaced L-shaped base retention arms 150 radially extending horizontally from a base plate 21 shown in FIG. 4; the base rentention arms 150 extending a distance greater than that of the radius of the reel 15. The base retention arms 150 then extend vertically to a height greater than the reel 15. The base retention arms 150 then extend inwardly to define a horizontal segment 75 preferably having a length approximately one sixth the diameter of the base 20. A circular shield 175 may be attached to the bottom of the base 20 so that the wire dispenser 10 can be placed on uneven surfaces without blocking the rotation of the reel 15. It will be understood that shield 175 may replace the radially extending horizontal portion of arms 150.

The inner reel 15 comprises a plurality of equally spaced L-shaped reel retention arms 100 radially extending horizontally from the bottom of the reel cylinder 110, the reel retention arms 100 extending a distance less than the radius of the base 20. The reel retention arms then extend vertically to a height less than the base arms 22–36. A reel retaining ring 105 interconnects the ends of the vertical portion of the reel retention arms 100.

In this embodiment of the present invention there is no wire guide 120 located on the base retaining ring 80 and all arms 160 have the inwardly extending segments 75. The base retaining ring 170 interconnects the ends of all inwardly extending segments 75 to form a circle. The metal spool 146 is placed over the post 140 and the wire is pulled from the spool over the reel retaining ring 105 and then through the sides of the base between any two vertical base retaining arms 150, 155, 160, 165. The base retention arms 150–165, the inwardly extending segments 75 and the base retaining ring 170 above and over the dispensing reel and spool of wire, all keep the wire from uncoiling horizontally or vertically and prevent crimps and bends from occurring allowing the wire user to work without having to straighten or untangle the wire.

Many modifications of the present invention will be apparent to those skilled in the art since variations in the shape of the reel cylinder 110 on the reel 15 and the size of the reel 15 to accommodate special situations will be apparent to the user. Also, the base 20 could be constructed of solid metal rather than the open case as shown.

The preferred embodiment of the present invention has been disclosed by way of example and it will be understood that other modifications may occur to those skilled in the art without departing from the scope and the spirit of the appended claims.

I claim:

1. A portable dispenser for wire and the like comprising:

a reel including means for supporting a coil of said wire and a vertical tubular bearing member;

a stationary base comprising a central inner bearing post for receiving said tubular bearing, annularly disposed side retaining means surrounding the circumference of said reel for controlling horizontal movement of coils of said wire, and annularly disposed upper retaining means extending inwardly from said side retaining means a portion of the distance to said bearing post for controlling vertical movement of coils of said wire; and an opening defined in said base through said side retaining means for allowing wire to be withdrawn;

said reel rotating within said base as said wire is dispensed linearly from said reel.

2. A portable dispenser for wire and the like comprising:

a base;

a pivot post rigidly mounted on said base and extending upwardly; and a reel;

said base comprising a base frame including retaining extensions comprising a plurality of L-shaped base arms connected to said post and radiating horizontally a distance greater than the radius of said reel and then vertically to a height greater than said reel;

said retaining extensions connected to inwardly extending arms over said reel, said inwardly extending arms being interconnected by a base retaining ring;

said reel comprising a reel frame including an axially located cylinder that is slideably mounted on said post;

said reel frame comprising a plurality of radial L-shaped reel arms connected to to the lower portion of said cylinder, and a reel retaining ring attached to the upper end of said L-shaped reel arms.

3. The dispensing device of claim 2 wherein a nylon bushing is located at the lower end of said pivot for receiving said cylinder.

4. The dispensing device of claim 2 wherein said base includes a wire guide connected to said base retaining ring.

5. The dispensing device of claim 2 wherein the portion of said base retaining ring connected to said wire guide extends to and connects with said retaining extensions.

6. The dispensing device of claim 2 further comprising said base having a circular plate axially mounted beneath said plurality of base arms of a diameter equal to that of said base.

* * * * *